US006896751B2

(12) United States Patent
Posson et al.

(10) Patent No.: US 6,896,751 B2
(45) Date of Patent: May 24, 2005

(54) ENERGETICS BINDER OF FLUOROELASTOMER OR OTHER LATEX

(75) Inventors: Philip L. Posson, Cave Creek, AZ (US); Mark Clark, Glendale, AZ (US); Jim Cornwell, Glendale, AZ (US)

(73) Assignee: Universal Propulsion Company, Inc., Phoenix, AZ (US)

( * ) Notice: Subject to any disclaimer, the term of this patent is extended or adjusted under 35 U.S.C. 154(b) by 108 days.

(21) Appl. No.: 10/439,015

(22) Filed: May 16, 2003

(65) Prior Publication Data

US 2004/0226638 A1 Nov. 18, 2004

(51) Int. Cl.[7] ..... C06B 45/10; D03D 23/00
(52) U.S. Cl. ..... 149/19.92; 149/109.6
(58) Field of Search ..... 149/19.92, 109.6

(56) References Cited

U.S. PATENT DOCUMENTS

| | | | | |
|---|---|---|---|---|
| 3,725,516 | A | 4/1973 | Kaufman | 264/3 B |
| 3,833,432 | A | 9/1974 | Moy et al. | 149/19.3 |
| 3,876,477 | A | 4/1975 | Eldridge | 149/19.3 |
| 4,098,625 | A | 7/1978 | French et al. | 149/19.3 |
| 4,482,405 | A | 11/1984 | Wright | 149/19.3 |
| 4,981,535 | A | 1/1991 | Hadermann et al. | 149/19.92 |
| 5,507,891 | A | 4/1996 | Zeigler | 149/47 |
| 5,531,844 | A | 7/1996 | Brown et al. | 149/19.3 |
| 5,565,150 | A | 10/1996 | Dillehay et al. | 264/3.3 |
| 5,565,710 | A | 10/1996 | Ochi | 264/3.4 |
| 5,574,248 | A | 11/1996 | Brown et al. | 149/19.3 |
| 5,623,120 | A | 4/1997 | Brown et al. | 149/19.3 |
| 5,627,339 | A | 5/1997 | Brown et al. | 149/19.3 |
| 5,741,999 | A | 4/1998 | Kazumi et al. | 149/35 |
| 5,886,293 | A | 3/1999 | Nauflett et al. | 149/109.6 |
| RE36,296 | E | 9/1999 | Zeigler | 149/47 |
| 6,427,599 | B1 | 8/2002 | Posson et al. | 102/336 |

OTHER PUBLICATIONS

Web Page for Tecnoflon TN Latex Fluoroelaster Specialty Polymer (http://www.ausimont.com/docs/spec_tnla-tex.html), printed Aug. 27, 2002.

*Primary Examiner*—Aileen Felton
(74) *Attorney, Agent, or Firm*—Jerry Holden

(57) ABSTRACT

A propellant composition including a fuel, an oxidizer, and a latex binder and method of making, wherein the method of making eliminates the need for the large amounts of volatile, flammable solvents that are typically associated with the traditional process.

22 Claims, 2 Drawing Sheets

ENERGETICS BINDER OF FLUOROELASTOMER OR OTHER LATEX

FIELD OF THE INVENTION

The present invention relates to a pyrotechnic composition and the method for making the composition that includes a fuel, an oxidizer, and a latex binder. The method of the invention reduces the need for large amounts of volatile, flammable solvents that are typically associated with the traditional "shock gelling" process. In particular, the method of the invention involves mixing a latex binder and a compatible nonsolvent organic fluid to provide an extended binder that is mixed with a fuel and an oxidizer to provide a propellant composition, then treating the mixture with a gellant liquid to provide a thick, uniform, dough-like material that is ready for further processing.

BACKGROUND OF THE INVENTION

Propellant compositions have a wide variety of uses, for example, inflation, expulsion, and flotation devices, such as vehicle occupant restraint bags, and commercial and military devices, such as fire suppression devices, piston operated mechanical devices, rocket engines, and munitions. As a result of the diversity and desirability of these compositions, manufacturers strive to improve production methods, reduce costs and waste, and increase safety.

Pyrotechnic propellant compositions typically include a fuel, usually metallic in nature, an oxidizer, and optionally, a binder system that serves as an adhesive, holding the fuel and oxidant in a well-mixed condition. Without a binder, many compositions separate under the influence of gravity or vibration, resulting in performance degradation. In addition, the binder may serve as part of the fuel, and aid in maintaining the final product in a defined physical condition. The binder often causes changes in the burning rate of the composition, so that binder concentrations must be substantially uniform throughout the mass of composition for controllable performance. Therefore, proper mixing and incorporation of the binder during manufacture are key process parameters.

One known method for manufacturing propellant compositions involves dissolving a binder in acetone or other solvent and loading the solution into a muller-type mixer prior to addition of the fuel particles or oxidizer. The concentration of binder in the fluid is typically 10–20%, to keep the viscosity of the fluid down in a convenient working range. Fine metallic powder or other fuel is then added to the mixer, and after a time, an oxidizer, such as polytetrafluoroethylene (PTFE) or a metal salt oxidizer, is also loaded into the mixer. The slurry is mixed until the solvent evaporates to form a dough-like consistency, which is spread on trays and placed in large ovens for complete drying. After drying, the cakes are granulated for feedstock to the process. The process is time consuming and labor intensive. In addition, process workers are exposed to high-hazard conditions.

Another process for manufacturing propellant compositions uses a "shock precipitation" or "Cowles Dissolver" method, as shown in FIG. 1. U.S. Pat. No. 3,876,477 describes a process wherein the binder is dissolved in acetone and placed in a Cowles Dissolver. The fuel and oxidizer components are then suspended in the binder solution and a countersolvent is added while mixing the solution. A large amount (about 4 times the volume of the solution) of countersolvent, e.g., hexane, causes the binder to precipitate from the solvent. As the binder precipitates, the active particles are entrapped in the binder. The solids are then filtered, dried, and pressed or extruded. This process, is also time consuming and results in major waste disposal problems with the large amounts of volatile, flammable solvents used during the process. When performed manually, the operator is also at risk because of the close proximity to the mixing process and the large volume of solvent, as well as the propellant particles. U.S. Pat. No. 6,132,536 also discloses a shock precipitation method, however, the process is automated to reduce safety concerns with the manual process.

Thus, there remains a need for a less-hazardous, less expensive method for making a propellant composition with no reduction of pyrotechnic properties associated with the more hazardous and costly methods currently used. It would be desirable to accelerate production, and avoid the use of large quantities of volatile solvents and the safety hazards associated therewith. The present invention provides a method for manufacturing propellant compositions that reduces the amount of volatile solvent used, accelerates the processing time, and increases process safety.

SUMMARY OF THE INVENTION

The present invention is directed to a pyrotechnic composition and methods for its manufacture.

One embodiment of the invention relates to a propellant composition having a latex binder extended with a nonsolvent organic liquid, a second gellant liquid, an oxidizer, and a fuel. The composition also may have chemical modifiers such as plasticizers, curing agents, catalysts or burn rate modifiers, antioxidants, or dispersants. In addition, the composition also may have processing aids such as lubricants, anti-static agents, mold release agents.

Some embodiments of the invention are directed toward particular types of one or more constituents of the composition. For example, in one embodiment of the invention the nonsolvent organic liquid may be denatured methyl alcohol, ethyl alcohol, isopropyl alcohol, or a mixture of these alcohols. In yet another embodiment, the latex binder is selected from fluoroelastomers, latex forms of acrylic resins, polyvinyl butyral, carboxy modified rubber, nitrile modified rubber, polyvinyl chloride, polybutadiene, acrylonitrile-styrene-butadiene, vinyl pyridine, styrene butadiene polymer latex, and compatible mixtures thereof.

In yet another embodiment, the oxidizer is selected from 1,3,5-trinitro-1,3,5-triaza-cyclohexane, 1,3,5,7-tetranitro-1,3,5,7-tetraaza-cyclooctane, ammonium dinitramide, 1,3,3-trinitroazetidine, potassium nitrate, and mixtures thereof. Moreover, in one embodiment of the invention the fuel contains at least one metal such as silicon, boron, aluminum, magnesium, and titanium, aluminum-magnesium alloy, or titanium hydride.

Another embodiment of the present invention relates to methods for making the compositions described above. For example, one method involves the steps of mixing a latex binder with a nonsolvent liquid to provide an extended latex binder, blending the extended latex binder with a fuel and an oxidizer to form a slurry, adding solvent to the slurry to destablize the extended latex binder and agitating the slurry to form a mixed, thickened slurry. The composition is then dried, extruded, shaped, formed, or otherwise processed for use in a pyrotechnic product or device.

Some embodiments of the invention further define some of the steps described above or include additional steps. For instance, after solvent is added to the slurry to destabilize the extended latex binder and to form a mixed, thickened slurry, the solvent level of the slurry may be reduced, such as by vacuum or ventilation. In one embodiment, the amount of solvent added to the slurry to destabilize the extended latex binder is about 2 times or less the volume of the slurry. In yet another embodiment the step of mixing a latex binder with a nonsolvent liquid further comprises adding water.

As described above for the inventive composition, some embodiments of the inventive method relate to particular types of one or more constituents of the composition, such as the types of nonsolvent organic liquids, latex binders, oxidizers, or fuels that may be used in making the composition. For instance, in one embodiment the nonsolvent liquid comprises denatured methyl alcohol, ethyl alcohol, 2-butanone, acetonitrile or a mixture thereof.

BRIEF DESCRIPTION OF THE DRAWINGS

Further features and advantages of the invention can be ascertained from the following detailed description that is provided in connection with the drawings as described below.

DETAILED DESCRIPTION OF THE INVENTION

Figure 1:
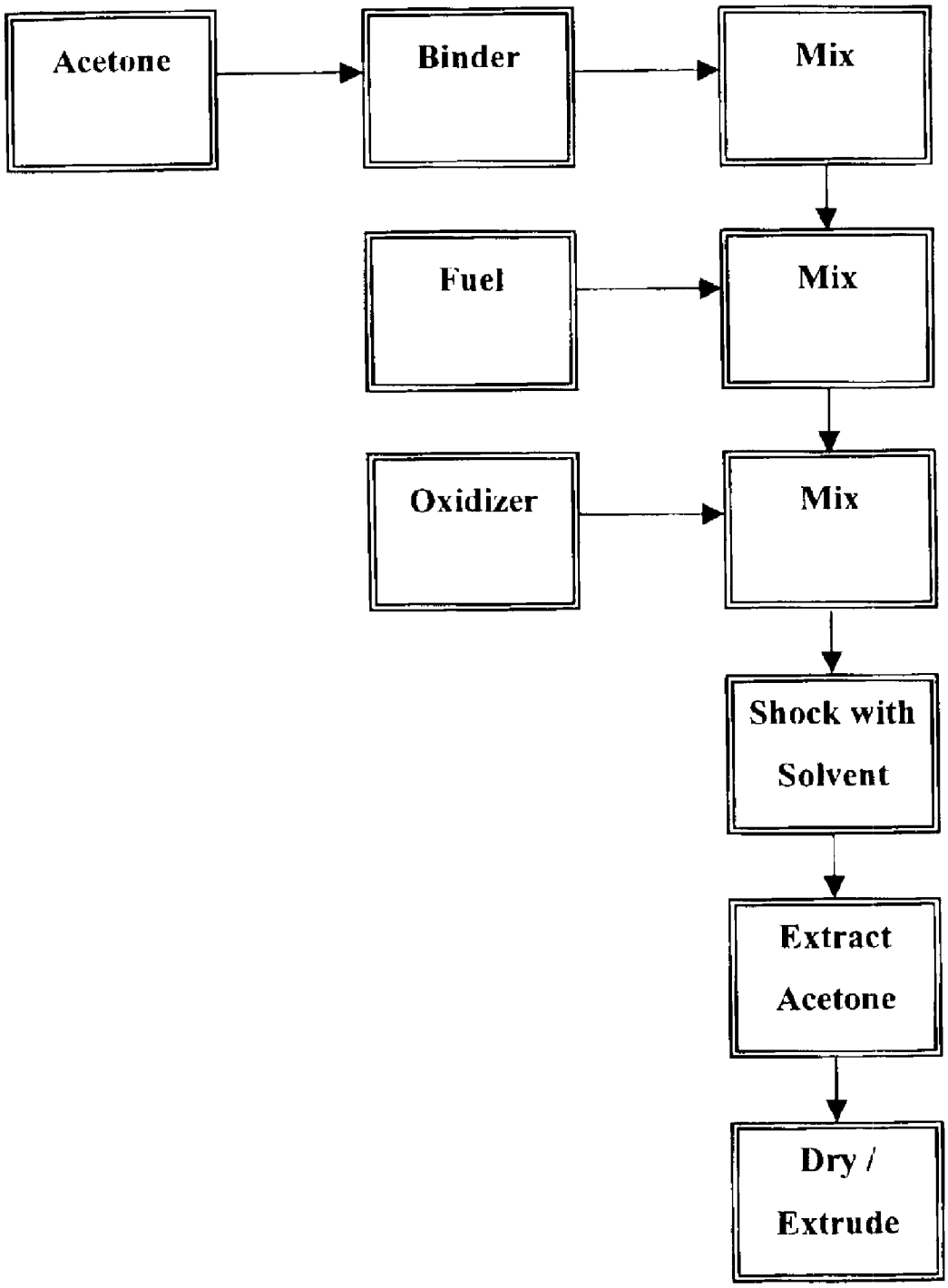
FIG. 1 is a flow diagram illustrating a prior art process of making a propellant composition.
Figure 2:
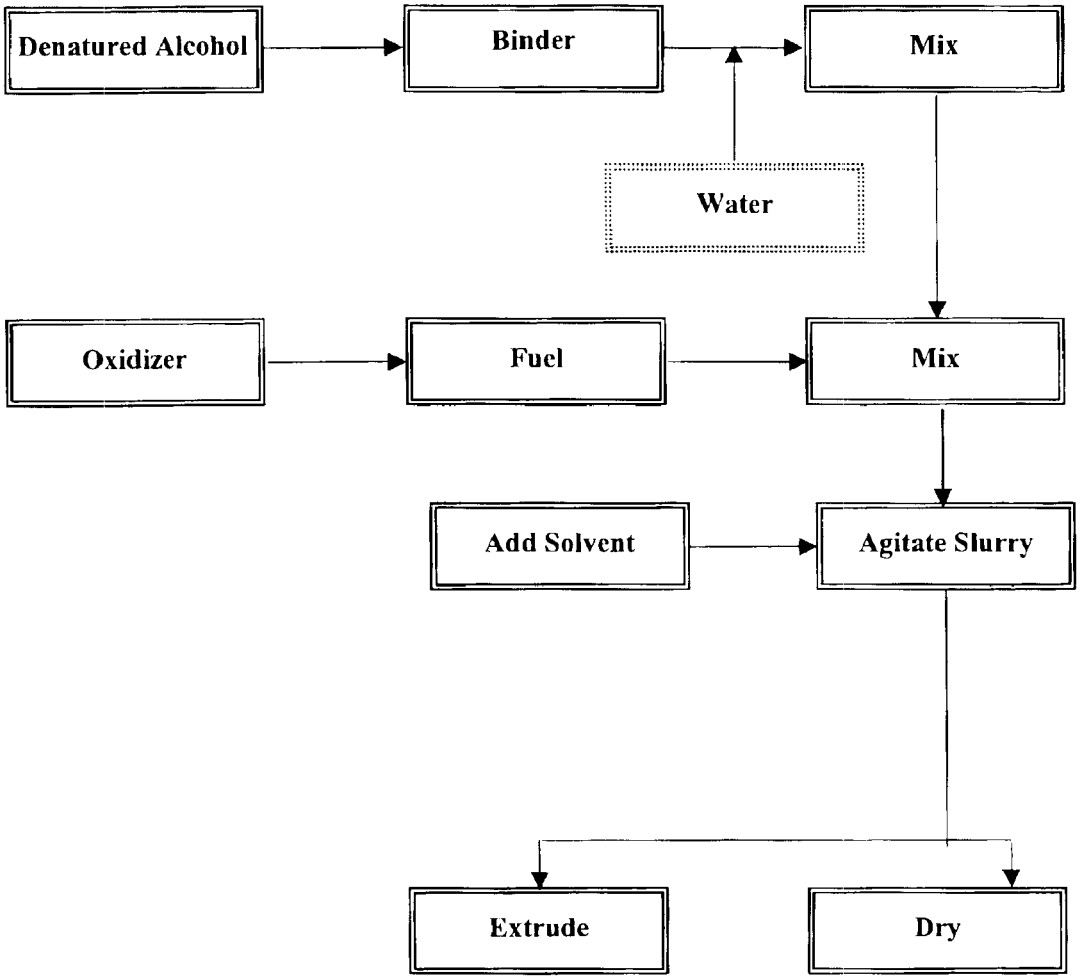
FIG. 2 is a flow diagram illustrating the process of making a propellant composition according to the present invention.

The present invention is directed to a pyrotechnic composition and method for making the composition that overcomes or reduces the environmental and safety issues associated with the current methods without sacrificing the beneficial properties of the propellant or pyrotechnic. In one embodiment, the composition of the present invention is based on an extended binder, emulsion, or dispersion, a primary fuel, an oxidizer, and a gellant for the binder. Optional additional additives, such as plasticizers, metal reaction stabilizers, curatives, antioxidants, burn rate catalysts, and cure catalysts may also be added to the compositions of the invention.

The method is particularly applicable to the preparation of metal powder/oxidant/polymer pyrotechnic blends, but may also be used to coat any particles in general with a polymeric binder. For example, the method can be used to coat metallic particles to inhibit air oxidation during storage, or to prepare metal powder compositions that are injection moldable.

Binder(s)

A binder component is used in the compositions of the invention to hold the reactive materials together in the finished propellant form. In this capacity, the binder allows shaping or forming of the propellant composition into a substantially nonporous solid mass. A binder also typically helps supply the necessary physical integrity required to help survive vibration and other disruptive forces that may occur. In some cases, oxygen, chlorine, or fluorine in the binder act as auxiliary oxidizers for the metal fuel.

The binder compound may be selected to minimize water vapor production on combustion. Binders with a reduced potential for water vapor formation include fluorocarbons and fluorocarbon elastomers, chlorinated materials such as poly (vinyl chloride or vinylidene chloride) copolymers, polyacrylonitrile copolymers, and polyesters such as poly (hydroxyacetic/lactic acid).

The binder systems of the invention are preferably in the form of a latex, i.e., an emulsion of the polymer in water, and extended with a compatible fluid. The binder system used in the composition includes at least a binder, or binder resin, and various additional components. Suitable binders, include, but are not limited to, fluoroelastomers, latex forms of acrylic resins, polyvinyl butyral, carboxy modified rubber, nitrile modified rubber, polyvinyl chloride, polybutadiene, acrylonitrile-styrene-butadiene, vinyl pyridine, styrene butadiene polymer latex, oxidized polyolefins, or compatible mixtures thereof.

In one embodiment, the binder includes a terpolymer of hexafluoropropylene, vinylidene fluoride and optionally tetrafluoroethylene. The binder systems of the present invention are preferably solvent free, highly concentrated water based emulsions of a fluoroelastomer terpolymer. The fluoroelastomer terpolymer may have a solids content of about 40 to about 80 weight percent and a fluorine content of about 80 to about 40 weight percent of the polymer. In one embodiment, the solids content is about 60 to about 75 weight percent and the fluorine content is about 75 to about 60 weight percent of the polymer. In another embodiment, the solids content is about 70 percent or greater by weight of the polymer and the fluorine content is about 68 percent or greater by weight of the polymer. A commercial example of a fluoropolymer latex suitable for use with the present invention is manufactured by Ausimont USA of Thorofare, N.J. under the tradename Technoflon Tenn.

In one embodiment, the binder may include specially-made emulsions. For example, a Hi-Temp™ acrylic polymer with a suitable plasticizer as described below, e.g., di octyl adipate (DOA), may be made into a latex with an emulsifier, e.g., TRITON X-100®, for the production of pressable or extrudable pyrotechnic compositions. In another example, curing-type binder systems, such as a dimmer acid/epoxidized vegetable oil/metal carboxylate may also be emulsified.

As mentioned above, binders also act to hold the reactive materials together and maintain a shaped propellant composition in finished form to help control combustion. In one embodiment, the binder system may be mixed and later cured so that the physical shape of the product is easily maintained. For example, an emulsified mixture of maleic anhydride-terminated and hydroxy-terminated polybutadiene plus a fatty tertiary amine catalyst may serve to retain the shape of the product.

Chemical stability of the binder systems used in the present invention is also important so that they will not react with the oxidizer component prior to combustion. The determination of the appropriate binder type and other binder system components, and amounts suitable for use therewith, will be readily understood by one of ordinary skill in the art when selected according to the teachings herein.

In one embodiment, the binder is present in an amount about 25 percent or less of the total composition. Preferably, the binder is included in the composition in an amount about 10 percent or less by weight of the total composition. In another embodiment, the binder is present in an amount from about 5 percent to 15 percent by weight of the composition.

Primary Fuel

Any form of an active fuel component is suitable for forming the pyrotechnic compositions of the invention. In one embodiment, the active fuel component is in powder form. In another embodiment, the fuel component is a metallic powder. Oxidizable inorganic fuels, preferably of metals or metalloids, such as silicon, boron, aluminum, magnesium, and titanium, may be used as primary fuel sources. In one embodiment, aluminum powder is used in combination with the oxidizer.

The concentration of the fuel component may vary depending on the type or types of fuel components selected. Any concentration of active fuel components suitable for combustion may be employed; however, an active fuel component is typically present in a concentration of greater than about 5 percent, preferably greater than about 8 percent, and more preferably greater than about 12 percent by weight of the pyrotechnic composition, and/or is preferably present in a concentration of about 60 percent or less, more preferably about 40 percent or less, and even more preferably about 38 percent or less by weight of pyrotechnic composition. In one embodiment, the composition includes about 5 percent to about 50 percent of the fuel component by weight of the total composition. In another embodiment, the fuel component is present in an amount from about 10 percent to about 35 percent by weight of the total composition.

The size and shape of the active fuel component particles may be any size and/or shape suitable for combustion. In one embodiment, the particle size is greater than about 3 $\mu$m in diameter. In another embodiment, the particle size is about 10 $\mu$m or greater. In yet another embodiment, the particle size is about 100 $\mu$m or less, preferably less than about 50 $\mu$m or less, and more preferably less than about 30 $\mu$m or less.

Oxidizer

Oxidizing agents assist in the combustion of fuel compounds of the pyrotechnic composition. Thus, an oxidizing agent may be used in the pyrotechnic compositions of the invention to accelerate combustion, thus facilitating more rapid gas and heat generation.

Suitable oxidizing agents include, but are not limited to, alkali metal nitrates, bromates, chlorates, perchlorates, or mixtures thereof. Specific examples of suitable oxidizing agents include, but are not limited to, potassium nitrate, potassium perchlorate, sodium nitrate, lithium nitrate or perchlorate, ammonium perchlorate ammonium nitrate, barium nitrate, strontium nitrate and (basic) cupric nitrate. The oxidizer(s) used in the propellant compositions of the present invention may also include solid nitramines such as 1,3,5-trinitro-1,3,5-triaza-cyclohexane (RDX), 1,3,5,7-tetranitro-1,3,5,7-tetraaza-cyclooctane (HMX), ammonium dinitramide (ADN), 1,3,3-trinitroazetidine, and mixtures thereof.

The oxidizer of the present invention may also be an inorganic halogen-containing component, such as the halides disclosed in co-pending U.S. patent application Ser. No. 10/197,468, filed Jul. 18, 2002, entitled "High Density-Impulse Propellant With Minimal or No Toxic Exhaust Products," which is incorporated in its entirety by reference herein. In this embodiment, the halide-containing oxidizer is preferably bromate or iodate. In one embodiment, the inorganic halogen-containing component is an alkaline bromate, e.g., lithium bromate ($LiBrO_3$) potassium bromate ($KBrO_3$), sodium bromate ($NaBrO_3$), or cesium bromate ($CsBrO_3$). In another embodiment, the inorganic halogen-containing component is an alkaline earth bromate, e.g., magnesium bromate ($Mg(BrO_3)_2$), calcium bromate ($Ca(BrO_3)_2$), strontium bromate ($Sr(BrO_3)_2$), and barium bromate ($Ba(BrO_3)_2$).

The slower-acting oxidizing agents, such as potassium nitrate ($KNO_3$), may also be combined with combustion accelerants or other alkaline earth halates, e.g., $KBrO_3$, to increase the combustion rate. Measurement of the combustion rate and optimization thereof are readily understood by those of ordinary skill in the art. In addition, other oxidizers, such as those listed above, may be blended with the bromate and/or iodate to reduce the density-impulse while still providing other desirable performance characteristics.

The oxidizing agent may be present in any amount suitable for assisting combustion of the active fuel component. In one embodiment, the oxidizing agent is present in an amount greater than about 40 percent, preferably greater than about 50 percent, and even more preferably greater than about 60 percent by weight of the propellant composition. In another embodiment, the oxidizer is present in an amount of about 95 percent or less, preferably about 85 percent or less, and even more preferably about 80 percent or less by weight of the propellant composition. In yet another embodiment, the oxidizer is present in an amount from about 60 to about 90 weight percent of the composition, preferably in an amount from about 70 to about 80 weight percent of the composition. In still another embodiment, the oxidizer is present in an amount from about 80 to about 90 weight percent of the composition.

Oxidizing agents may be of a form similar to that described for active fuel components, namely powders or any other suitable form for forming a pyrotechnic composition mixture. In one embodiment, the oxidizing agent is in powder form with particle size of about 3 $\mu$m or greater in diameter, preferably about 4 $\mu$m or greater, and even more preferably about 5 $\mu$m or greater. In another embodiment, the particle size of the oxidizer is about 200 $\mu$m or less in diameter, preferably about 80 $\mu$m or less, and more preferably about 50 $\mu$m or less.

Additional Components

Various additional components may also be used in the binder system or propellant composition to improve the physical properties of the propellant. For example, plasticizers and processing aids may also be added to the composition to enhance processing. The binder system may include one or more of a curing or bonding agent, a cure catalyst, an antioxidant, an opacifier, or a halide scavenger, such as potassium or lithium carbonate. Generally, curing agents, plasticizers, or other processing aids are optionally present in the composition from about 15 weight percent or less, based on the total weight of the composition.

The additives may be introduced in the diluent when extending the binder or with the solvent during high-shear mixing. For example, a binder modifier resin may be used, such as a high molecular weight fluoroelastomer Dyneon THV 220A manufactured by Dyneon of Decatur, Ala., or Viton GLT manufactured by the DuPont Company.

Energetic and nonenergetic plasticizers may be added to the binder system, depending on whether the propellant composition is intended to be low energy or high energy. Suitable energetic plasticizers include, but are not limited to, bis(2,2-dinitropropyl) acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), or mixtures thereof. Typical nonenergetic plasticizers include triacetin, acetyltriethylcitrate (ATEC), dioctyladipate (DOA), isodecyl perlargonate (IDP), dioctylphthalate (DOP), dioctylmaleate (DOM), dibutylphthalate (DBP), ethylene carbonate, propylene carbonate, or mixtures thereof. In one embodiment, the plasticizer is present in an amount about 10 percent or less by weight of the propellant composition. In another embodiment, the plasticizer is present in an amount less than 5 percent by weight of the propellant composition.

Antioxidants, curing agents, and catalysts may be present in a total amount about 5 percent or less by weight of the total propellant composition, and, more preferably, about 2 percent or less by weight.

When a curing agent is used, a cure catalyst is preferably also included to accelerate the curing reaction between the curable binder and the curing agent. Suitable cure catalysts may include alkyl tin dilaurate, metal acetylacetonate, or triphenyl bismuth. The cure catalyst, when used, is generally present from about 0.01 percent to about 2 percent by weight, and, preferably, from about 0.01 percent to about 1 percent by weight of total propellant composition. In another preferred embodiment, the cure catalyst is present in an amount about 0.05 weight percent or less.

Finely divided high energy additives, such as metallic particles, may be used to increase the combustion rate of the propellant composition of the present invention. In one embodiment, the metallic particles or powders are in the micron-scale range.

Metallic nanoparticles are also contemplated by the present invention. In one embodiment, metallic nanoparticles are used to produce a burning propellant with a low burn rate/pressure slope. Since metallic nanoparticles are smaller in diameter than even the ultrafine metal powders currently available, their surface area per volume, and reactivity, is immensely greater. A higher burning rate increases the rapid initiation rate that a propellant can achieve, as shown with conventional pyrotechnic propellants. When such nanoparticles are used, a corrosion-preventative additive should be used, such as an alkali sebacate, silicate, molybdate, compatible salt of an organic phosphate ester, octylphosphonic acid or an imidizole compound such as Sarcosyl (Ciba Geigy) or nitromethane as an absorptive corrosion inhibitor.

A catalyst or modifier may also be used in the composition of the invention to increase the burn rate of the composition. Non-limiting examples of suitable burn rate catalyst/modifiers include iron oxide ($Fe_2O_3$), $K_2B_{12}H_{12}$, $Bi_2MoO_6$, ferrocene ($Fe(C_5H_5)_2$), chromium, copper, graphite, carbon powders, and carbon fibers.

The addition of lubricants in the propellant compositions of the present invention may help reduce friction as the crystals slip past one another and, thus, prevent unwanted accidental reaction. Because of this reaction prevention mechanism, the friction sensitivity of the propellant composition may be reduced. For example, the minimum allowable friction sensitivity for shipping is 80 Newtons using the UN friction testing apparatus. The addition of a lubricant into the propellant composition of the invention may improve the measured value by about 10 to about 30 percent. Thus, a composition having a non-allowable or non-measurable friction sensitivity using the UN friction testing apparatus may be improved and, thus measurable, with the addition of an internal lubricant. Suitable solid lubricants are graphite or hexagonal boron nitride, or castor oil-derived wax.

When used, the addition of lubricants may generally be present in an amount about 0.1 percent or greater. In one embodiment, the lubricant(s) is present in an amount about 10 percent or less.

Antioxidants may also be used in the binder system. Suitable antioxidants may include 2,2'-bis(4-methyl-6-tert-butylphenol) available from American Cyanamid Co. of Parsippany, N.J. under the tradename AO-2246, 4,4'-bis(4-methyl-6-tert-butylphenol), BHT, BHA, or mixtures thereof. In one embodiment, the antioxidant is present in an amount of about 0.05 percent to about 1 percent by weight of the total propellant composition. In another embodiment, the antioxidant is present in an amount about 0.5 percent or less by weight of the total propellant composition.

An opacifier, e.g., carbon black, also may be used in the binder system, generally in an amount from about 0.01 percent to 2 percent by weight. Preferably, the opacifier is present in an amount about 1 percent by weight or less.

Dispersants may also be added to a powder/solvent mixture to reduce agglomeration tendency of individual particles during processing. For example, a dispersant tends to disperse and subdivide individual active fuel/additive/oxidizer agglomerates and thus to increase the degree of incorporation with other components. The agents also have utility as a coupling agents, increasing the practical utility of the bond between polymeric binder and active fuel and or oxidizer particles. A dispersing agent also tends to reduce the apparent viscosity of a powder/solvent mixture, and consequently the already-small amount of solvent required to process the mixtures of the invention.

Non-limiting examples of dispersing agents include organotitanates, lecithin, complete or partial fatty acid esters of polyhydroxy compounds, soluble fluorocarbon materials containing integral polar molecular entities, the alkylamine adducts of dimer acid, alkylated polyvinyl pyrrolidines, cationic surfactants such as lauryl pyridinium chloride, ethoxylated soya amine, TRITON X-400 quaternary chloride available from Rohm and Haas of Philadelphia, Pa., certain copolymers of ethylene and propylene oxide, alkyl polyoxyalkylene phosphates, and SURFYNOL 104 tertiary acetylenic glycol available from Air Products of Allentown, Pa. Although any suitable concentration may be used, dispersant agents are preferably present in an amount from about 0.01 percent to about 3 percent, preferably about 0.05 percent to about 1.5 percent, and more preferably about 0.1 percent to about 1 percent by weight of the composition.

Fine reinforcing fibers may also be dispersed in the pyrotechnic composition in a proportion that advantageously enhances the physical and safety aspects of the finished product. In this aspect of the invention, the oxidizer content may be slightly increased to ensure complete combustion or destruction of the added fibers. The fibers are preferably use in the composition in an amount of about 0.1 percent to about 3 percent, though amounts less than about 0.1 percent and greater than about 3 percent, by weight of the compositions are also contemplated by the present invention. Suitable fibers include, but are not limited to, high-tenacity polyester, cellulose or cellulosic derivative, polyamide, polyolefin, polyacrylonitrile, Rayon, acrylic copolymers, and mixtures thereof.

In addition, any suitable mold release agent known in the art may be added to the compositions of the invention. For example, mold release agents such as ethylene bisstearamide manufactured by Lonza Group of Switzerland under the trade name Aacrawax C Atomized, polytetrafluroethylene ("PTFE") powders, zinc stearate, calcium stearate, low molecular weight polyolefin powder, low molecular weight polyolefin dispersions, pentaerythritol tetrastearate, and mixtures thereof may be used. Mold release agents may be employed in any suitable concentration. In one embodiment, the mold release agent is present in an amount of about 0.05 percent to about 2 percent, preferably about 0.1 percent to about 1 percent, and more preferably about 0.2 percent to about 0.6 percent by weight of the propellant composition.

Production Method

The pyrotechnic composition of the invention may be made according to the following steps: (1) providing a latex binder and blending it in a suitable non-gelling extender; (2) blending the extended latex binder, a fuel, an oxidizer and optional modifying ingredients to form a slurry; (3) adding a small amount of solvent to the slurry to destabilize the extended latex binder and mixing the ingredients by agitation or other suitable means to provide a thickened slurry;

and (4) drying, granulating, pressing and/or extruding the product. The thickened slurry may also be extruded as such into a housing such as a booster cup, or to act as a stand-alone energetic unit upon final evaporation of the solvents present.

In Step 1, the binder of the present invention may be applied to or admixed with the reactive materials of the propellant composition in any suitable manner, such as including as a fluid, subdivided solid, dispersion, or solution. In one embodiment, the latex binder is extended with a nonsolvent liquid. The nonsolvent liquid is a low molecular weight aliphatic alcohol, e.g., methyl alcohol or ethyl alcohol or a mixture thereof. The amount of nonsolvent liquid, preferably about 2 percent to about 70 percent, may also serve in the extended latex binder mixture to minimize undesired solubility of the fuel and oxidizer particles. In one embodiment, the amount of nonsolvent liquid present is about 5 percent to about 60 percent by weight of the solution.

In addition, a small amount of water may be added to the binder. For example, about 30 percent to about 80 percent by weight of the extended latex binder may be water. In one embodiment, about 30 percent to about 60 percent by weight of the extended latex binder may be water.

Step 2 involves blending the latex binder, a fuel, and an oxidizer to form a slurry. This step is performed with sufficient shear to break up agglomerates and thoroughly mix the ingredients. Non-limiting examples of apparatus that may be used to perform this high shear mixing step include a Simpson Mix-Muller available from Simpson Group of Aurora, Ill., a Stomacher® kneading device, a high shear rotary mixer, or a Hobart® mixer. When using a high shear rotary mixer, enough fluid must be present to maintain the proper viscosity conditions required by the device.

Conventional methods of making pyrotechnic compositions employ large amounts of solvent, e.g., about 4 times the volume of the slurry, to help ensure that a binder is distributed over the surfaces of the active fuel and oxidizer components. The role of the solvent in the present invention, however, is to destabilize the extended latex binder and swell the polymer present. Thus, the amount of solvent is greatly reduced over that of conventional methods.

Step 3 of the method of the present invention involves adding solvent to the slurry and agitating, preferably at high shear, wherein the volume of the solvent is about 2 times or less the volume of the slurry. In another embodiment, the solvent volume is about equal to the slurry volume. In yet another embodiment, the volume of the solvent is about half or less the volume of the slurry. In still another embodiment, the solvent volume is about a quarter or less of the slurry volume.

Thus, in one embodiment, the amount of solvent used is about 50 percent or less of the amount of solvent used in conventional methods. In another embodiment, the solvent used is reduced by about 70 percent or greater over traditional methods. In yet another embodiment, the reduction in solvent is about 90 percent or greater as compared to the amount of solvent used in conventional methods.

Any solvent suitable for destabilizing the extended latex binder may be employed in the method of the present invention. It is preferred that the solvent does not dissolve and/or react with the fuel(s) and oxidizing agents. This feature aids in maintaining a small and uniform fuel particle size and, therefore, uniformity of the fuel composition burn rate.

Suitable solvents include, but are not limited to, acetone, methyl ethyl ketone, ethyl acetate, butyl acetate, propyl acetate, methyl t-butyl ether, methyl t-amyl ether, tetrahydrofuran, supercritical fluids, and/or mixtures thereof. In one embodiment, the solvent includes acetone.

A solvent or emulsion-breaking agent is typically chosen so as not to adversely affect the proportion, particle size or chemical purity of the active fuel or oxidizer. A nonsolvent is also typically selected so that it does not remove or destroy auxiliary ingredients such as antioxidants, dispersants, etc. that are desired to be in the finished composition.

After addition of the solvent, the slurry thickens and mixing continues with evaporation until a suitable dough viscosity is obtained for subsequent processing.

Mixing may be performed under vacuum or ventilation, i.e., warm dry air flow or warm inert gas flow, to evaporate the solvent. As mentioned above, however, because a reduced amount of solvent is used, the conventional solvent decanting step is unneeded in the method of the present invention.

Step 4 involves granulating and drying, pressing, or extruding the product for use by conventional means. Shaped propellant compositions may be formed by any suitable shaping method known in the art including, but not limited to, pressing, molding, casting, or extrusion techniques. In one embodiment, the propellant composition is formed by pressing, casting or otherwise producing a preform of composition that remains substantially damp with process fluid, removing the process fluid by any suitable method as above, and then compacting or extruding such preform.

In another embodiment, the propellant composition is extruded by adding small amounts of the composition, e.g., drops or small slugs, to a solvent bath. The solvent bath may include any suitable solvent, such as those discussed above. For example, in one embodiment, the solvent bath includes acetone. In another embodiment, the solvent bath includes methyl ethyl ketone (MEK). The exterior of the particles gel to preserve their shape. In the event that the shaped particles are removed prior to dissolution, the granules may be dried thereby forming particles that may be used as a gas-generating propellant or ignition charge. During the drying step, a free-flow agent, e.g., graphite or Aluminum Oxide "C" (Degussa Corporation) may be used to facilitate flow and increase resistance to static discharge.

EXAMPLES

Embodiments of the present invention may be more fully understood by reference to the following examples. Table 1 lists the compositional make-up and amount of mixing solvent typically employed in conventional processes verses the present invention. While these examples are meant to be illustrative of propellant compositions made according to the present invention, the present invention is not meant to be limited by the following examples. All parts are by weight unless otherwise specified.

TABLE 1

Propellant Compositions

| Component | U.S. Pat. No. 3,876,477 | U.S. Pat. No. 3,725,516 | Present Invention |
|---|---|---|---|
| Latex Binder | Not applicable | Not applicable | 5%–15% |
| Binder | 25% Teflon<br>15% Viton A | 18.5% Viton | 0% |
| Fuel | 20%<br>Aluminum | 18.15%<br>Aluminum | 32% $TiH_2$ |

TABLE 1-continued

| Propellant Compositions | | | |
|---|---|---|---|
| Component | U.S. Pat. No. 3,876,477 | U.S. Pat. No. 3,725,516 | Present Invention |
| Oxidizer | 35% Potassium Perchlorate | 54.6% Ammonium Perchlorate | 63% $KClO_4$ |
| Chemical Modifiers | 5.0% | 9.1% | <25% |
| Mixing Solutions (Percent Weight of Additive Compounds) | | | |
| Hexane | 400% | 300% | Not applicable |
| Binder Extender | Not applicable | Not applicable | 15% ethanol |
| Gellant | Not applicable | Not applicable | 10% acetone |

The present invention is further illustrated by the following Examples:

Example 1

Because fuels such as $TiH_2$ are dangerous to handle, instead of fuel an inert black iron oxide powder was used to simulate the fuel in the present invention. Ethanol was added to Technoflon® latex until 23% solids by weight was reached. No gellant was used. The extended Technoflon® was mixed with the black iron oxide. At 8.3% Technoflon® solids binder, granules were weak and incompetent.

Example 2

Black iron oxide powder was mixed with ethanol-extended Fluoroelastomer latex, and granulated at 5.7% binder. The granules were very lightly agglomerated, soft and fell to powder on handling.

Example 3

Black iron oxide powder was replaced with a fuel simulant of 60% zinc powder and 40% atomized aluminum. 0.71 grams of Technoflon TN fluorocarbon latex and 1.8 grams ethanol were added to 9.5 grams of the simulant. The composition was mixed and 1.0 grams acetone was added. The mixture suddenly thickened. Upon drying, the composition made strong abrasion-resistant granules at 5.0% binder. The addition of the gellant resulted in large improvements over the results of Examples 1 and 2.

Example 4

950 grams Zn—Al powder fuel simulant, 71 grams TN latex, 180 grams ethanol were mixed thoroughly. 100 grams of acetone were then added to the mixture. The mixture promptly gelled. The mixture was then dried at 150-Fahrenheit for about 30 minutes. The resulting product was visually uniform and resisted casual abrasion. The product formed competent granules, rendered free flowing by addition of 0.1% Aluminum Oxide C. The granules fed well though a vibratory feeder. In comparison to the prior art "shock gel" process, the present invention uses 93.4% less solvent.

All patents and patent applications cited in the foregoing text are expressly incorporated herein by reference in their entirety.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method of making a propellant composition, comprising the following steps:

mixing a latex binder with a nonsolvent liquid to provide an extended latex binder;

blending the extended latex binder, a fuel, and an oxidizer to form a slurry;

adding a solvent to the slurry to destabilize the extended latex binder;

agitating the slurry to provide a mixed, thickened slurry; and, optionally, reducing the solvent content to facilitate further processing by means of vacuum or ventilation; and drying, extruding, or otherwise processing the solid material by conventional means, either to make it suitable for further processing, or by shaping and/or placing it in a form, cup, or other device which can be used in a pyrotechnic product or device.

2. The method of claim 1, wherein the step of mixing a latex binder with a nonsolvent liquid further comprises adding water.

3. The method of claim 1, wherein the nonsolvent liquid comprises denatured methyl alcohol, ethyl alcohol, butanone, acetonitrile, or a mixture thereof and wherein the solvent comprises acetone, methyl ethyl ketone, ethyl acetate, butyl acetate, propyl acetate, methyl t-butyl ether, methyl t-amyl ether, tetrahydrofuran, supercritical fluids, or mixtures thereof.

4. The method of claim 1, wherein the latex binder is selected from the group consisting of fluoroelastomers, latex forms of acrylic resins, polyvinyl butyral, carboxy modified rubber, nitrile modified rubber, polyvinyl chloride, polybutadiene, acrylonitrile-styrene-butadiene, vinyl pyridine, styrene butadiene polymer latex, and compatible mixtures thereof.

5. The method of claim 1, wherein the step of adding a solvent to the slurry to destabilize the extended latex binder comprises adding the solvent in an amount of about 2 times or less the volume of the slurry.

6. A method of making a propellant composition, comprising the following steps:

providing a latex binder;

blending the latex binder in a non-gelling extender to form an extended latex binder;

mixing the extended latex binder, a fuel, and an oxidizer to form a slurry;

adding a solvent to the slurry;

mixing the slurry; and processing the slurry to provide the propellant composition.

7. The method of claim 6, wherein the latex binder is selected from the group consisting of fluoroelastomers, latex forms of acrylic resins, polyvinyl butyral, carboxy modified rubber, nitrile modified rubber, polyvinyl chloride, polybutadiene, acrylonitrile-styrene-butadiene, vinyl pyridine, styrene butadiene polymer latex, and compatible mixtures thereof.

8. The method of claim 6, wherein the step of providing the latex binder comprises providing the later binder in the form of a fluid, subdivided solid, dispersion, or solution.

9. The method of claim 6, wherein the non-gelling extender comprises a low molecular weight aliphatic alcohol.

10. The method of claim 6, wherein the step of blending the latex binder further comprises providing the non-gelling extender in an amount of about 5 percent to about 60 percent by weight of the latex binder.

11. The method of claim 6, further comprising the step of blending the latex binder in a non-gelling extender further comprises adding water to form the extended latex binder.

12. The method of claim 11, wherein the water is present in an amount of about 30 percent to about 60 percent by weight of the extended latex binder.

13. The method of claim 6, wherein the step of mixing is performed with sufficient shear to break up agglomerates.

14. The method of claim 6, wherein the step of adding a solvent comprises adding an amount of solvent about half or less the volume of the slurry.

15. The method of claim 6, wherein the solvent is selected from the group consisting of acetone, methyl ethyl ketone, ethyl acetate, butyl acetate, propyl acetate, methyl t-butyl ether, methyl t-amyl ether, tetrahydrofuran, supercritical fluids, and mixtures thereof.

16. The method of claim 4, wherein the latex binder is selected from the group consisting of fluoroelastomers, latex forms of acrylic resins, and mixtures thereof.

17. A method of making a propellant composition, comprising the following steps:

providing a latex binder;

blending the latex binder in a non-gelling extender to form an extended latex binder solution;

mixing the extended latex binder solution, a fuel comprising a metallic powder selected from the group consisting of silicon, boron, aluminum, magnesium, titanium, and mixtures thereof, and an oxidizer to form a slurry;

adding a solvent to the slurry in an amount of about a quarter or less of the volume of the slurry;

mixing the slurry; and processing the slurry to provide the propellant composition.

18. The method of claim 17, wherein the step of blending the latex binder in a non-gelling extender to form an extended latex binder solution further comprises adding water in an amount of about 30 percent to 80 percent by weight of the extended latex binder solution.

19. The method of claim 17, wherein the step of providing a latex binder comprises providing a terpolymer of hexafluoropropylene, vinylidene fluoride, and tetrafluoroethylene.

20. The method of claim 19, wherein the terpolymer comprises about 40 to 80 percent solids and about 80 to 40 percent fluorine by weight of the terpolymer.

21. The method of claim 17, wherein the step of providing a latex binder comprises the steps of:

providing an acrylic polymer;

providing a plasticizer;

forming the latex binder by mixing the acrylic polymer and plasticizer with an emulsifier.

22. The method of claim 17, wherein the latex binder is present in an amount of about 5 percent to 15 percent by weight of the slurry.

* * * * *